United States Patent [19]

Ap

[11] Patent Number: 4,685,430

[45] Date of Patent: Aug. 11, 1987

[54] MOTOR VEHICLE EXHAUST GAS HEAT EXCHANGER FOR HEATING ENGINE COOLANT AND LUBRICATING OIL

[75] Inventor: Ngy S. Ap, Villepinte, France

[73] Assignee: VALEO, Paris, France

[21] Appl. No.: 841,423

[22] Filed: Mar. 19, 1986

[30] Foreign Application Priority Data

Mar. 20, 1985 [FR] France ..... 85 04154
Mar. 20, 1985 [FR] France ..... 85 04155

[51] Int. Cl.[4] ..... F02N 17/02; F01M 1/00

[52] U.S. Cl. ..... 123/142.5 R; 123/41.33; 123/196 AB; 165/51; 165/140; 165/35; 60/320

[58] Field of Search ..... 165/51, 140, 35; 123/552, 142.5 R, 41.33, 196 AB; 60/320

[56] References Cited

U.S. PATENT DOCUMENTS

| | | | |
|---|---|---|---|
| 1,937,514 | 12/1933 | Foutz | 123/142.5 R |
| 2,268,979 | 1/1942 | Williamson et al. | 165/51 |
| 2,303,613 | 12/1942 | Charlton . | |
| 2,617,399 | 11/1952 | Backus | 123/142.5 R |
| 2,916,030 | 12/1959 | Hoeth | 165/51 |
| 4,258,676 | 3/1981 | Lamm | 123/142.5 R |
| 4,391,235 | 7/1983 | Majkrzak | 123/142.5 R |
| 4,537,349 | 8/1985 | Stolz | 123/142.5 R |

FOREIGN PATENT DOCUMENTS

| | | | |
|---|---|---|---|
| 519090 | 12/1955 | Canada | 123/142.5 R |
| 0119651 | 9/1984 | European Pat. Off. . | |
| 2717159 | 11/1978 | Fed. Rep. of Germany | 165/51 |
| 2939086 | 4/1981 | Fed. Rep. of Germany R | 123/142.5 |
| 2937579 | 4/1981 | Fed. Rep. of Germany . | |
| 2122867 | 9/1972 | France . | |
| 2255473 | 7/1975 | France . | |
| 2489415 | 3/1982 | France . | |
| 137274 | 9/1952 | Sweden | 165/140 |
| 552188 | 3/1948 | United Kingdom . | |
| 2065859 | 7/1981 | United Kingdom | 165/140 |
| 2097115 | 10/1982 | United Kingdom . | |

*Primary Examiner*—William R. Cline
*Assistant Examiner*—John K. Ford
*Attorney, Agent, or Firm*—Dennison, Meserole, Pollack & Scheiner

[57] ABSTRACT

The invention relates to a motor vehicle heat exchagner, the heat exchanger comprising a fluid box (10) having the ends of tubes (22) opening out therein, said tubes constituting a heat exchange bundle located inside an envelope (24). Engine exhaust gases flow through said box (10) and said tubes (22), and engine cooling liquid or cabin heater air flow through said envelope (24). The envelope is connected to the fluid box (10) by a tubular element (30) and a perforated plate (18). The envelope (24) is made of a lightweight material which need not be capable of witstanding exhaust gas temperatures.

8 Claims, 5 Drawing Figures

MOTOR VEHICLE EXHAUST GAS HEAT EXCHANGER FOR HEATING ENGINE COOLANT AND LUBRICATING OIL

The invention relates to a motor vehicle heat exchanger, in particular of the type comprising a circuit for passing the exhaust gases from the internal combustion engine driving the vehicle, thereby making it possible on cold-starting the engine to rapidly heat up the cooling liquid and/or the lubricating oil of said engine.

BACKGROUND OF THE INVENTION

Proposals have already been made to use the heat of exhaust gases during cold-starting and running of an internal combustion engine in order to raise the temperature of the cooling liquid and/or of the engine lubricating oil very rapidly, thereby considerably reducing fuel consumption.

However, known heat exchangers are relatively heavy and are only useful during a relatively small proportion of the total running time of the engine.

Preferred embodiments of the present invention provide a heat exchanger of the above-specified type, but which is relatively light.

SUMMARY OF THE INVENTION

The present invention provides a heat exchanger for a motor vehicle, said heat exchanger comprising a bundle of tubes whose ends are sealed in the holes of a perforated plate, said perforated plate having a fluid box fixed thereto and said tube ends opening out into said fluid box, said fluid box including at least one inlet and/or outlet for a first fluid, said heat exchanger including the improvement of a tubular element interposed between the collector and an envelope surrounding the bundle of tubes, said envelope being made of plastic material or of a lightweight metal material unsuitable for withstanding high temperatures, while said fluid box, said perforated plate, and said tubular element are made of a material which withstands the high temperatures which may be reached by exhaust gases.

This provides a considerable weight saving.

Advantageously, the tubular element is made as a single piece in conjunction with the perforated plate.

The envelope is preferably provided with an inlet and an outlet for a second fluid which flows through said envelope and said tubular element.

In general, the first fluid flowing through the above-mentioned fluid box and through the tubes in the bundle of tubes is constituted by the exhaust gas from the engine, and the second fluid which flows through the envelope is constituted by a liquid or by air, and in particular by the engine cooling liquid or by air for heating the passenger cabin.

A heat exchanger in accordance with the invention assists vehicle cabin heating, not only during periods when the engine is cold-started or while it is running cold, but also at other times, if so desired.

The invention also provides for the above-mentioned envelope to contain a bundle of tubes having the engine lubricating oil passing therethrough.

Thus, when cold-starting the engine or while the engine is running cold, the lubricating oil is likewise heated by the exhaust gases, via the fluid circulating through said envelope. Furthermore, the fluid circulating through said envelope may be an intermediate heat exchange fluid for exchanging heat with the engine cooling liquid or with the vehicle cabin heater air, thereby avoiding any possibility of pollution from the exhaust gases or the lubricating oil.

BRIEF DESCRIPTION OF THE DRAWINGS

Embodiments of the invention are described by way of example with reference to the accompanying drawings, in which.

MORE DETAILED DESCRIPTION

Figure 1:
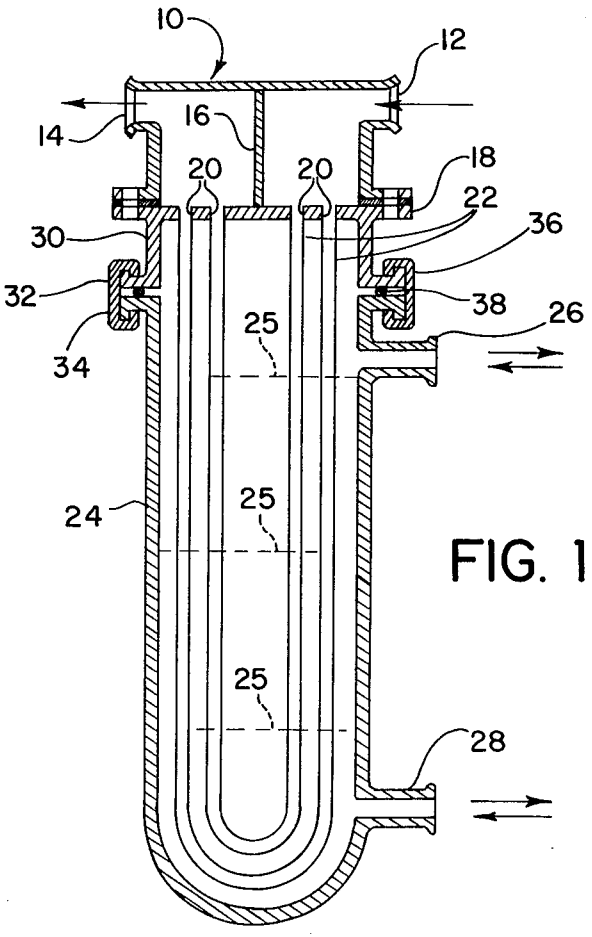
FIG. 1 is a diagrammatic longitudinal section through a heat exchanger in accordance with the invention.

Reference is made initially to FIG. 1 which shows a first heat exchanger in accordance with the invention and suitable for being fitted to a motor vehicle having an internal combustion engine.

The heat exchanger comprises a fluid box 10 having an inlet tube 12 and an outlet tube 14, and having an internal partition 16 which may be fixed or moving and which divides the internal volume of the box 10 into two separate chambers which are respectively connected to the inlet tube 12 and to the outlet tube 14.

This fluid box is mounted in sealed manner on the peripheral rim of a perforated plate 18 having holes 20 in which the ends of tubes 22 in a conventional U-shaped bundle of tubes are sealed.

The bundle of tubes 22 is sealed within an envelope 24 having two tubes 26 and 28 via which it may be connected to a fluid circuit such as the cooling liquid circuit of an internal combustion engine or the hot air circuit for a vehicle cabin, or else it may be connected to an intermediate fluid circuit, e.g., a freon circuit.

The perforated plate 18 of the heat exchanger is made as a single piece including a tubular element 30 having a peripheral flange 32 disposed opposite to the rim of the perforated plate on which the fluid box 10 is fixed. The peripheral flange 32 of the tubular element 30 cooperates with a peripheral flange 34 at the end of the envelope 24 in order to fix said envelope to the tubular element 30, e.g., by means of a system of tabs or clips 36.

One or more sealing rings 38 are interposed between the peripheral flanges 32 and 34 on the tubular element 30 and the envelope 24.

The inlet and outlet tubes 12 and 14 of the fluid box 10 are connected to the exhaust manifold of the internal combustion engine in such a manner as to cause the engine exhaust gases to enter into the box 10 via the tube 10, to flow round the tubes 22 in the bundle of tubes and then return to the box 10 before leaving said box via the outlet tube 14.

The engine cooling liquid, the intermediate fluid, or the air for heating the vehicle cabin which penetrates into the envelope 24 via one or other of the tubes 26 and 28, which then flows through the envelope and finally leaves via the other one of the tubes 28 and 26 passes around the tubes 22 in the bundle of tubes which is located inside the envelope 24.

When cold-starting the engine or when running it cold, the fluid which flows through the envelope 24 is heated by the engine exhaust gases which are at a temperature lying in the range 400° C. to 900° C. or 1000° C. or there abouts, depending on circumstances. When the fluid is the engine cooling liquid, its temperature is raised very quickly by heat exchange with the exhaust gases, thereby reducing the time taken for the engine to reach its operating temperature, and thus reducing its fuel consumption. When the fluid which flows through the envelope 24 is air for heating the vehicle cabin, this air is heated very rapidly and heats the passenger cabin before the engine reaches its normal operating temperature.

Naturally, if engine cooling liquid is made to flow through the envelope 24, its increase in temperature may be used not only to accelerate the rise in engine temperature but also to heat air which is blown into the passenger cabin.

The envelope 24 is permanently maintained at a relatively low temperature, e.g., less than 100° C., by the fluid flowing therethrough, and it can therefore be made of plastic material or of lightweight metal material, whereas the fluid box 10, the perforated plate 18, and the tubular element 30 must be made from a material or materials capable of withstanding the high temperatures of exhaust gases. The tubular element 30 is in permanent contact with the fluid flowing through the envelope 24 and its peripheral flange 32 on which the envelope 24 is fixed is maintained at a relatively low temperature for avoiding any risk of damaging the material of the envelope 24, whereas the perforated plate 18 is itself raised to a much higher temperature.

Figure 2:
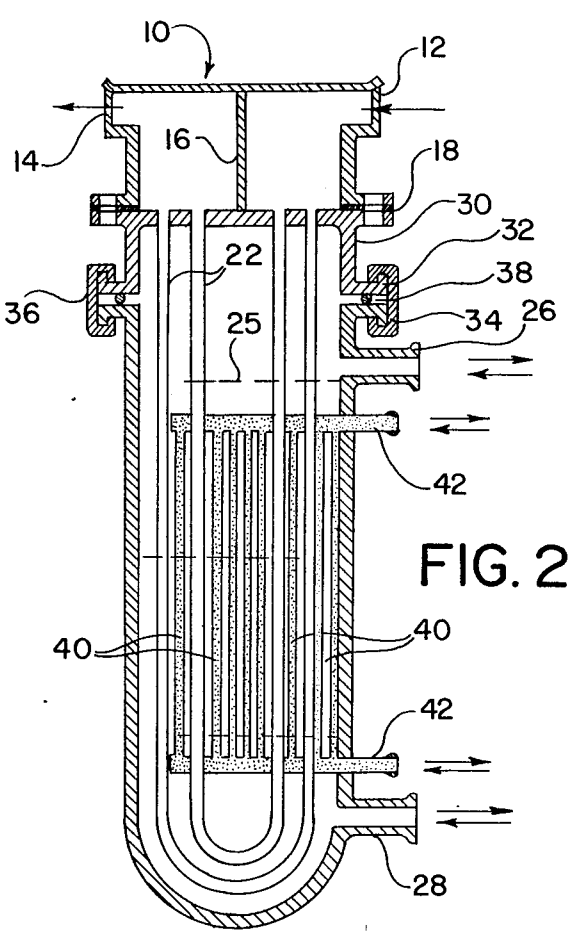
FIG. 2 is a diagrammatic longitudinal section through a variant of said heat exchanger.

Reference is now made to FIG. 2 which shows a variant heat exchanger in which the envelope 24 includes a further bundle of tubes 40 whose ends open out into two feed tubes 42 which pass, in sealed manner, through the wall of the envelope 24 and which are connected to the lubricating oil circuit of the internal combustion engine.

In this case, when cold-starting the engine or while it is running cold, the lubricating oil flowing through the tubes 40 is heated by the fluid flowing through the envelope 24 which is itself heated by the exhaust gases.

Figure 3:
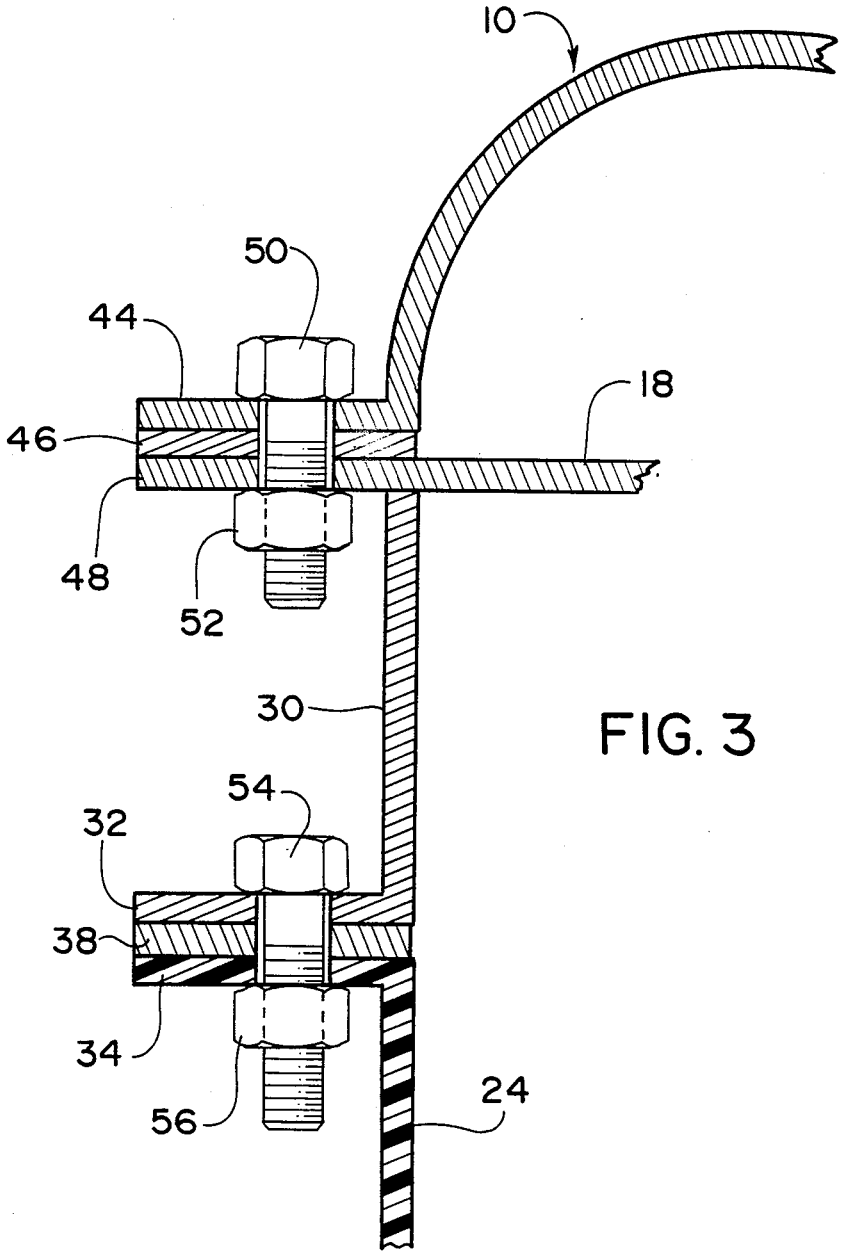
FIG. 3 is a view on a larger scale of a portion of a heat exchanger in accordance with the invention.

FIG. 3 is a more detailed view showing one method of assembling the fluid box 10 and the envelope 24 onto the perforated plate 18.

In this case, the fluid box 10 has a peripheral flange 44 which is pressed via a sealing ring 46 against a corresponding peripheral rim 48 of the perforated plate 18. Screws 50 pass through aligned holes in the flange 44, the sealing ring 46, and the rim 48, and in conjunction with nuts 52 serve to fix the flange 44 securely to the rim 48.

The peripheral flange 32 of the tubular element 30 (which is made as a single piece including the perforated plate 18) is fixed to the peripheral flange 34 on the end of the envelope 24 in the same manner, i.e. by means of screws 54 passing through aligned holes in the flange 32, the sealing ring 38, and the flange 34, and co-operating with nuts 56.

Naturally, it is not essential for the tubular element 30 to be made as a single piece with the perforated plate 18. The perforated plate 18 could be of conventional structure and the tubular element 30 would then have a peripheral flange at its top end and would then be assembled to the peripheral flange 44 on the fluid box 10 and to the peripheral rim 48 of the perforated plate 18, thereby enabling the perforated plate 18 to be a conventional flat plate which is clamped between the flanges of the fluid box and the tubular element 30.

Furthermore, and as shown in FIGS. 1 and 2, baffle partitions 25 may be disposed inside the envelope 24 in order to improve heat exchange between the exhaust gases and the fluid flowing through the envelope 24.

In a variant, the fluid flowing through the envelope 24 is an intermediate fluid for exchanging heat with the engine cooling liquid or with the cabin heater air, thereby avoiding any risk of polluting the cooling liquid or the air with exhaust gases or lubricating oil.

Figure 4:
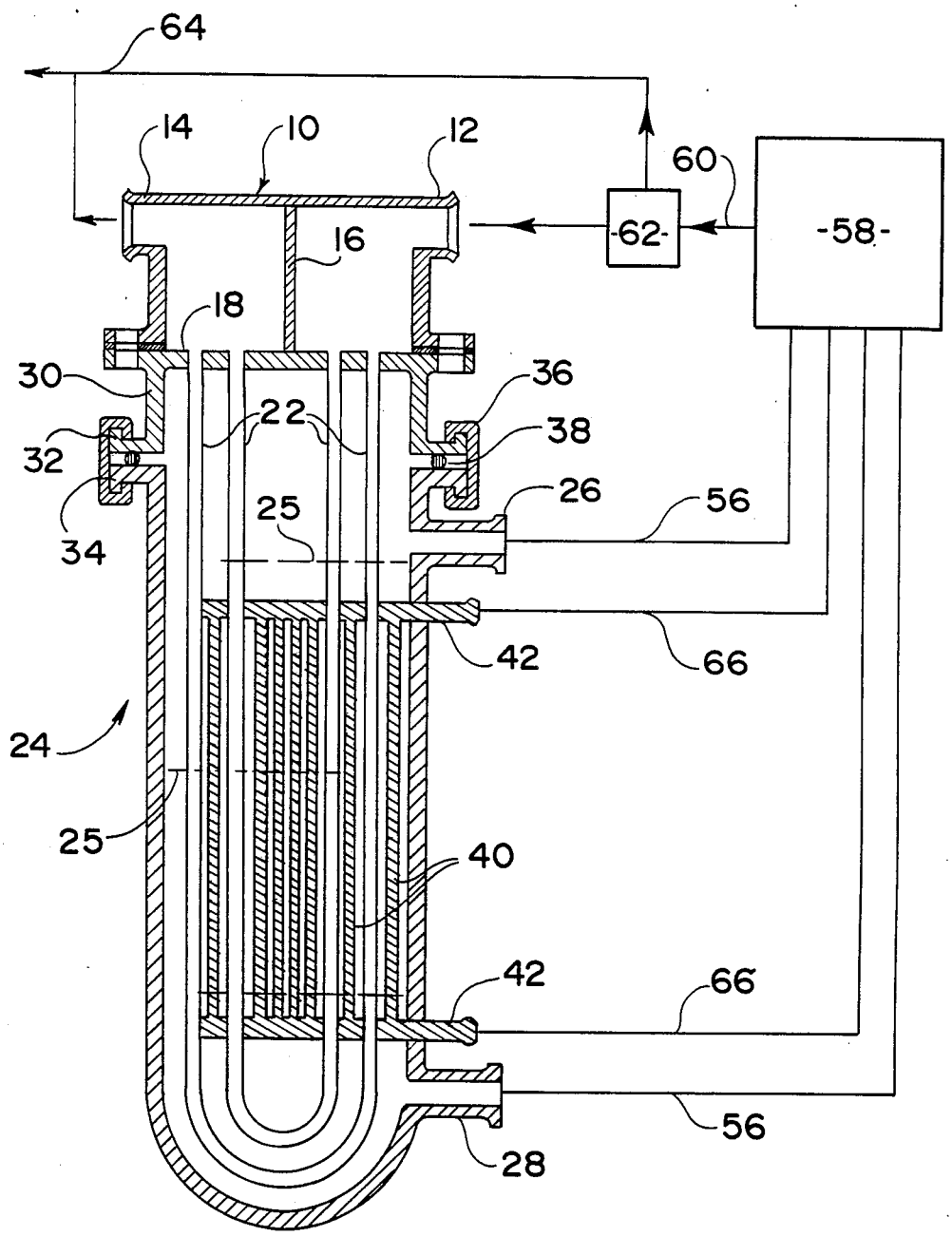
FIG. 4 is a diagram showing how a heat exchanger in accordance with the invention is included in a particular application.

Reference is now made to FIG. 4 which is a diagram showing how the FIG. 2 heat exchanger may be used in practice.

In this example, the inlet/outlet tubes 26 and 28 of the envelope 24 are connected to a cooling liquid circuit 56 for an internal combustion engine 58.

The exhaust manifold 60 of the engine is connected via a valve 62 either to the inlet tube 12 of the heat exchanger fluid box 10 or else to an exhaust pipe 64, thereby short-circuiting the heat exchanger. The outlet tube 14 from the fluid box 10 is likewise connected to the exhaust pipe 64. The valve 62 may be controlled by a thermostat as a function, for example, of the temperature of the engine cooling liquid.

The two tubes 42 for the oil radiator and passing in sealed manner through the wall of the envelope 24 are connected to the lubricating oil circuit 66 of the engine 58.

This heat exchanger operates as follows:

When cold-starting, or while the engine 58 has not not reached its normal operating temperature, the exhaust gases from the engine are conveyed via the valve 62 to the inlet tube 12 of the box 10, thereafter they flow through the tubes 22 in the bundle and return to the box 10 prior to leaving said box via the outlet tube 14 and the exhaust pipe 64. The engine cooling liquid enters the envelope 24 via one or other of the tubes 26 or 28, flows through said envelope in contact with the tubes 40 of the oil radiator and leaves the envelope 24 via the other one of the tubes 28 and 26. The lubricating oil flowing through the tubes 40 is heated by the engine cooling liquid, which is itself heated by the exhaust gases flowing through the tubes 22 of the bundle contained in the envelope 24.

Once the engine 58 has reached its normal operating temperature, the valve 62 is switched over and the exhaust manifold 60 is directly connected to the exhaust pipe 24 without passing through the bundle of tubes 22. In this case, the cooling liquid which flows through the envelope 24 serves to cool the engine lubricating oil which continues to flow through the tubes 40 of the oil radiator.

Figure 5:
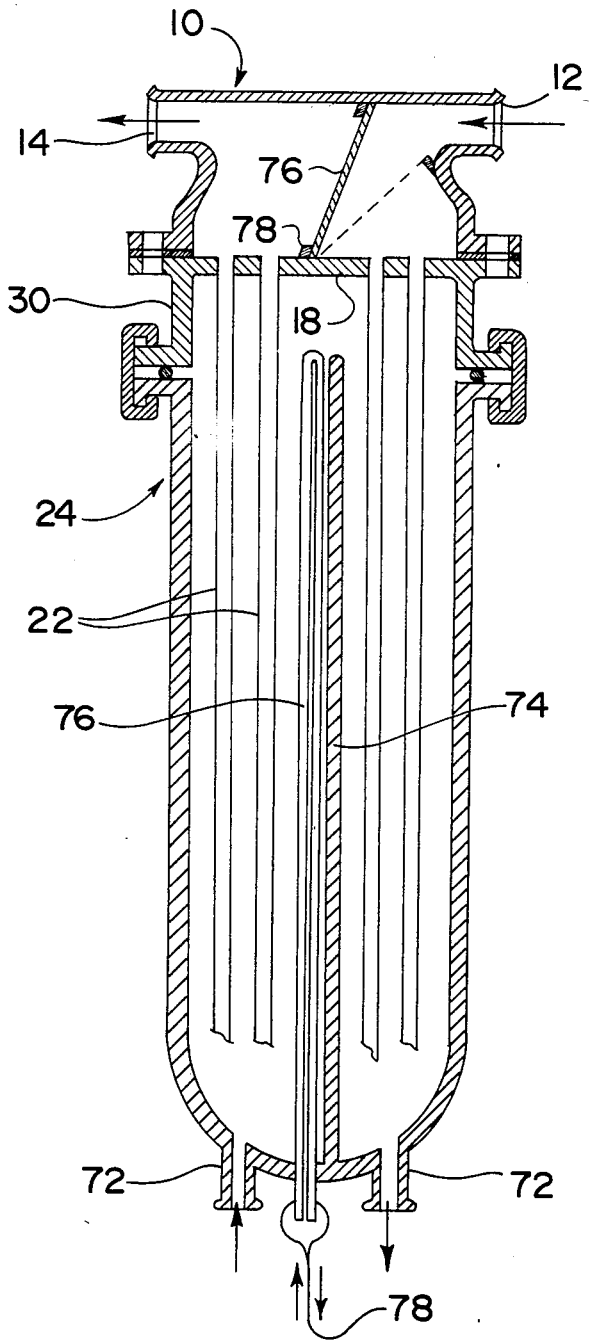
FIG. 5 is a view similar to FIG. 2, and shows a further variant of the invention.

Reference is now made to FIG. 5 which shows a variant of the heat exchanger shown in FIGS. 2 and 4.

In this variant, the fixed partition 16 in the fluid box 10 has been replaced by a moving partition 68 which is pivotally mounted about a shaft 70 located close to the perforated plate 18 and fixed thereon. The moving partition is displaced by means of a member sensitive to the temperature of the engine cooling liquid (like the valve 62 in FIG. 4) between a position which is shown in solid lines (where the inlet 12 and the outlet 14 are separated so that the exhaust gases entering the box 10 via the inlet 12 have to flow through the tubes 22 before reaching the outlet 14), and a position shown in dotted lines (where the exhaust gases can flow directly from the inlet 12 to the outlet 14 of the fluid box 10 without without flowing through the tubes 22 whose inlet ends are isolated from the inlet 12 of the box 10 by the partition 68).

The envelope 24 has two end fittings 72 at its bottom end for inlet and outlet of the second fluid or engine cooling liquid, which end fittings are separated by an internal partition 74 extending from the bottom of the envelope 24 to the vicinity of the top thereof. An oil radiator 76 is disposed inside the envelope 24 parallel to the tubes 20 and is connected to the oil circuit by two pipes 78 which pass in sealed manner through the bottom of the envelope 24.

This heat exchanger operates identically to that shown in FIG. 4.

What is claimed is:

1. In a combination of an internal combustion engine comprising a cooling circuit containing a cooling liquid and a lubricating circuit containing a lubricating liquid, and a heat exchanger comprising a bundle of tubes, a perforated plate in which the ends of said tubes are sealingly mounted, a fluid box fixed to said perforated plate opposite to said tubes with the ends of said tubes opening into said fluid box, means to introduce exhaust gas from said engine into said bundle of tubes at one end and to withdraw the gas from said bundle of tubes at the opposite end, the improvement comprising:

an envelope surrounding said bundle of tubes having an inlet means and an outlet means connected in said cooling circuit, said envelope being formed of a material adapted to withstand at least approximately the highest expected temperature of the cooling liquid, but less than the highest expected temperature of the exhaust gas, a tubular element surrounding said bundle of tubes and interposed between said perforated plate and said envelope, said tubular element, said fluid box and said perforated plate being formed of a material adapted to withstand the highest expected temperature of the exhaust gas, and at least one duct within said envelope in heat exchange relationship with the cooling liquid having inlet and outlet means passing through said envelope and being connected in said lubricating circuit.

2. A heat exchanger according to claim 1, wherein said means to introduce exhaust gas comprises an adjustable valve between said bundle of tubes and said engine, said valve being adapted to selectively provide exhaust gas to said bundle of tubes or divert exhaust gas from said bundle of tubes, whereby the exhaust gas heats the cooling liquid and the lubricating liquid when the valve provides exhaust gas to said bundle of tubes, and whereby the cooling liquid cools the lubricating liquid when the valve diverts exhaust gas from said bundle of tubes.

3. A heat exchanger according to claim 1, wherein said fluid box comprises a partition, said means to introduce exhaust gas on one side of said partition, and said means to withdraw the gas on the other side of said partition.

4. A heat exchanger according to claim 1, wherein said fluid box comprises said means to introduce exhaust gas, said means to withdraw exhaust gas, and a moving partition displaceable between a first position in which it isolates said means to introduce from said means to withdraw, thereby causing the exhaust gas to flow through said bundle of tubes, and a second position in which it isolates the exhaust gas from said bundle of tubes and directly connects said means to introduce to said means to withdraw, wherein in said first position the cooling liquid and the lubricating liquid are heated by the exhaust gases, and in said second position, the lubricating liquid is cooled by the cooling liquid.

5. A heat exchanger according to claim 1, wherein said envelope is formed of plastic.

6. A heat exchanger according to claim 1, wherein said envelope is formed of metal.

7. A heat exchanger according to claim 1, wherein said tubular element is constituted by a portion of a single piece which includes said perforated plate.

8. A heat exchanger according to claim 1, wherein said envelope includes at least one internal baffle for guiding said second fluid flowing therethrough.

* * * * *